US011219343B2

(12) United States Patent
Conrad, III et al.

(10) Patent No.: US 11,219,343 B2
(45) Date of Patent: Jan. 11, 2022

(54) POTTY TRAINING DEVICE

(71) Applicant: FOR KIDS BY PARENTS, INC., Potomac, MD (US)

(72) Inventors: Joseph Michael Conrad, III, Potomac, MD (US); Kurt G. Briscoe, Jersey City, NJ (US)

(73) Assignee: FOR KIDS BY PARENTS, INC., Potomac, MD (US)

( * ) Notice: Subject to any disclaimer, the term of this patent is extended or adjusted under 35 U.S.C. 154(b) by 139 days.

(21) Appl. No.: 16/364,495

(22) Filed: Mar. 26, 2019

(65) Prior Publication Data

US 2019/0261820 A1 Aug. 29, 2019

Related U.S. Application Data

(63) Continuation of application No. 13/554,193, filed on Jul. 20, 2012, now abandoned.

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/300.3
See application file for complete search history.

(56) References Cited

U.S. PATENT DOCUMENTS 936,714 A 10/1909 Gunton
964,533 A 7/1910 McDonald
1,682,798 A 9/1928 Richards
2,825,070 A 3/1958 Alexander et al.
3,566,421 A 3/1971 Waddle
4,292,763 A 10/1981 Barnes et al.
4,309,782 A 1/1982 Paulin
4,716,602 A 1/1988 Brickhouse
4,875,242 A 10/1989 Albrecht et al.
5,292,783 A 3/1994 Buchanan
5,391,423 A 2/1995 Wnuk
5,446,079 A 8/1995 Buchanan
5,489,470 A 2/1996 Noda
5,498,692 A 3/1996 Noda
5,559,858 A 9/1996 Beveridge
5,562,964 A 10/1996 Jones
5,580,911 A 12/1996 Buchanan
5,644,020 A 7/1997 Timmermann
(Continued)

FOREIGN PATENT DOCUMENTS

WO 2006 127444 11/2006

*Primary Examiner* — Huyen D Le
(74) *Attorney, Agent, or Firm* — Norris McLaughlin, P.A.

(57) ABSTRACT

A potting training device for preventing a potty training child's urine stream from passing through an opening between the toilet seat and the toilet bowl is made of a flexible, water-resistant, preferably non-porous material, having a bendable urine-deflector and a plurality of attachment tabs positioned at the top of, and substantially at right angles to, the bendable urine-deflector, thereby forming an L-shaped configuration. An adhesive material is applied to the surface of each attachment tab and attaches the attachment tabs to the underside of the toilet seat. When not attached to the underside of the toilet seat, the bendable urine-deflector has a flat configuration. In order to attach the potty training device to the underside of the toilet seat, it is manipulated into a curved configuration that matches the curvature of the toilet seat, and is attached thereto.

16 Claims, 3 Drawing Sheets

(56) References Cited

U.S. PATENT DOCUMENTS

| | | | |
|---|---|---|---|
| 5,849,401 | A | 12/1998 | El-Afandi |
| 5,853,876 | A | 12/1998 | Takano et al. |
| 5,910,545 | A | 6/1999 | Tsai |
| 6,081,937 | A | 7/2000 | Whitacre |
| 6,253,395 | B1 | 7/2001 | Quam |
| 6,289,527 | B1 | 9/2001 | Truettner |
| 6,473,911 | B2 | 11/2002 | Weiss |
| 6,514,602 | B1 | 2/2003 | Zhao |
| 6,573,350 | B1 | 6/2003 | Markel et al. |
| 6,708,350 | B2 | 3/2004 | Devereux |
| 7,870,619 | B2 | 1/2011 | Conrad, III et al. |
| 2006/0260031 | A1 | 11/2006 | Conrad |
| 2007/0056086 | A1 | 3/2007 | Raviendran |
| 2007/0151009 | A1 | 7/2007 | Conrad et al. |
| 2008/0016607 | A1 | 1/2008 | Cottage |
| 2009/0211007 | A1 | 8/2009 | Partridge |

POTTY TRAINING DEVICE

CROSS REFERENCE TO RELATED APPLICATIONS

This application is a continuation of U.S. Ser. No. 13/554,193, filed Jul. 20, 2012.

STATEMENT REGARDING FEDERALLY SPONSORED RESEARCH

Not applicable.

FIELD OF THE INVENTION

This invention is directed to a potty training device that functions as a urine-deflector when attached to the underside of an adult sized toilet seat. The invention is designed to block the opening formed between the toilet seat and the toilet bowl. This invention reduces accidental wetting of clothing and the floor that occurs when a child's urine stream passes through the opening between the toilet seat and the toilet bowl.

BACKGROUND OF THE INVENTION

It is a major accomplishment for a child to reach the stage of sitting on an adult toilet during potty training. Obtaining control over the direction of urine flow, however, may take some time for a child to master, particularly a male child. When sitting on the toilet, a child's urine stream is not always directed into the toilet. There are occasions where the child's urine stream finds its way out of the toilet through the opening formed between the toilet seat and the toilet bowl. This results in the urine stream coming in contact with the child's pants or other clothing and the floor. This can be very upsetting for a child who is trying to do their best to stay dry and master going to the toilet, as well as the parent who has to continually clean up the mess.

Urine deflecting devices are not new to the art. Many of the known devices, however, are designed for adult males to prevent urine from splashing onto the seat during urination from a standing position. Few potty training devices address preventing the urine stream from passing through the opening between the toilet seat and toilet bowl.

Truettner (U.S. Pat. No. 6,289,527) discloses a molded plastic device that attaches to the underside of the toilet seat to prevent a child's urine stream from passing through the opening formed between the toilet bowl and the toilet seat. When attached to the underside of the toilet seat, the prior art device is not visible when the toilet seat is down, unless viewed from a position to the rear of the attachment point.

However, this prior art device is bulky, which results in increased manufacturing and sales costs. The device is also difficult to clean and frequent replacement increases expense for the consumer. Another drawback is that the prior art device has a fixed configuration. Given the variety of toilet seat shapes, the fixed configuration of the prior art device limits its compatibility with many toilet seats. Therefore, in order to accommodate the full range of toilet seat shapes, the prior art device would have to be manufactured in a variety of configurations, adding additional expense to manufacturing costs and to the consumer.

What is needed is an inexpensive device that is effective for blocking the opening formed between the toilet seat and the toilet bowl, requires minimal manufacturing cost, and is easy to clean and replace without significant expense to the consumer. Additionally, there is a need for a single device that is flexible enough to match the curvature of any toilet seat and still remain hidden when the toilet seat is down, unless viewed from a position to the rear of the attachment point.

Our prior U.S. Pat. No. 7,870,619, the entire contents of which are incorporated herein by reference, meets these needs and others. The device is made of a flexible, water-resistant, preferably non-porous sheet material, having a folding seam separating a urine-deflecting surface and a plurality of attachment tabs. An adhesive material is applied to the surface of each attachment tab and bonds the attachment tabs to the underside of the toilet seat. The urine-deflecting surface hangs down from the underside of the toilet seat, blocking the opening between the toilet seat and the toilet bowl and, therefore, also, any urine directed towards such opening.

We have discovered, however, a problem associated with certain embodiments, specifically in the folding seam. We have found that when the device is folded about the folding seam located on the front of the device, particularly in the context of a thicker product, the act of folding about the folding seam creates a shelf that collects urine, which, over time, becomes strongly malodorous. On the other hand, relocating the seam to the back of the product can in some embodiments lead to pressure between the attachment tabs and the urine-deflecting surface tending to lift the urine-deflecting surface out of its optimal urine-deflecting position.

Accordingly, there is now a need for a device that has all the advantages of the device disclosed in our prior patent, but none of the disadvantages just discovered. These and other objects were met with the present invention, described hereinbelow.

BRIEF SUMMARY OF THE INVENTION

When attached to the underside of a toilet seat, the potty training device of the present invention effectively blocks the opening formed between the toilet seat and the toilet bowl and provides a simple and inexpensive solution to the above-described problems. Unlike the device described in our prior patent, the present device lacks a folding seam and, therefore, the problems that may be associated therewith in some embodiments. In its unattached configuration, the potty training device of the present invention comprises a bendable (or flexible) urine-deflector that has a flat configuration and a plurality of attachment tabs that are in contact with the urine-deflector. Each attachment tab is positioned at the top of the urine-deflector and oriented substantially at a right angle to the urine-deflector at the contact point. The potty training device of the present invention is therefore manufactured to have an "L-shaped" cross-section (or configuration) and is optionally prepackaged in the same manufactured L-shaped configuration (i.e., before sale and/or user manipulation and attachment to the underside of the toilet seat), as shown in FIG. 2. The invention in one embodiment, therefore, relates to an optionally sealed package, to be opened by a consumer-user, containing the potty training device having the L-shaped cross-section.

In defining the cross-sectional, angular positional relationship of the attachment tabs relative to the urine-defector, the meaning of phrase "substantially at a right angle" is an angle between the attachment tabs and the urine-deflector that is between about 45 degrees and about 90 degrees, or between about 90 degrees and about 135 degrees, preferably about 90 degrees and most preferably exactly 90 degrees.

In order to achieve its attached configuration on the underside of a toilet seat, the potty training device shown in FIGS. 1-3 is manipulated into a curved configuration by bending the left and right edges of the bendable urine-deflector inward, thereby resulting in the curved configurations shown in FIGS. 4-5, and then attached to the underside of a toilet seat, as shown in FIGS. 6-7. The plurality of attachment tabs further comprises a means for attaching the potty training device to the underside of a toilet seat. In an embodiment of the present invention, each attachment tab has layered thereon, an adhesive material, which provides the means for attaching the potty training device to the underside of the toilet seat.

The potty training device of the present invention may be manufactured from any material that is flexible, water-resistant and preferably non-porous. The material used to manufacture the potty training device should also be strong and flexible enough to resist tearing or breaking during manual manipulation and attachment to, and removal from, the underside of the toilet seat.

For the purposes of description, reference number 1 in the relevant figures refers to either a single attachment tab or a plurality of attachment tabs. When referring to more than one attachment tab, the phrase "plurality of attachment tabs" is used throughout the specification, unless otherwise indicated. The use of the terms "bendable" and "flexible" are used interchangeably throughout the specification and are taken to have the same meaning. The terms "bendable" or "flexible" may optionally appear before the term "urine-deflector" throughout the specification. In the absence of the terms "bendable" or "flexible" preceding the term "urine-deflector", it is understood that the "urine-deflector" possesses the characteristic of being "bendable" or "flexible."

DETAILED DESCRIPTION OF THE INVENTION

Figure 2:
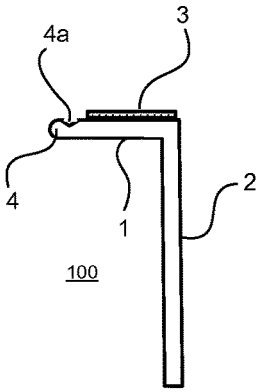
FIG. 2 is a cross sectional view of the potty training device of the present invention depicted in FIG. 1, taken along line 2-2, showing its "L-shaped" configuration.
Figure 7:
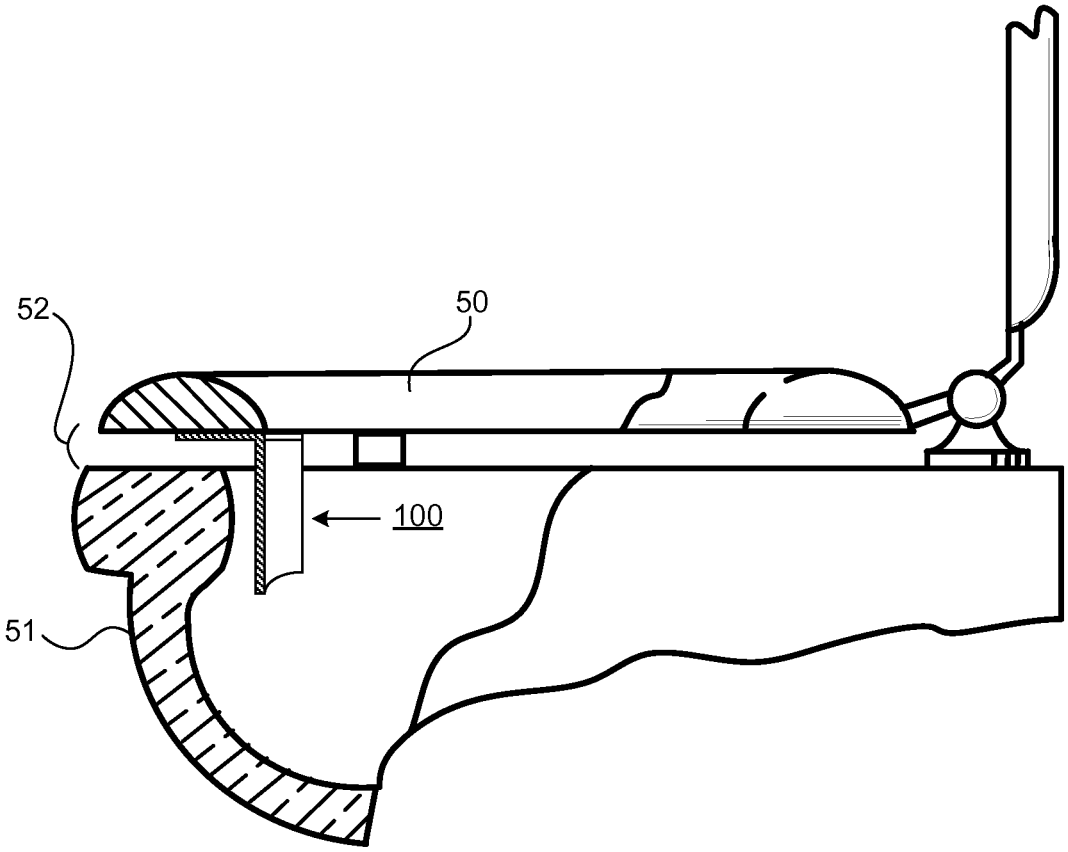
FIG. 7 is a cross-sectional side view of the urine-deflector attached to the underside of a toilet seat, as depicted in FIG. 6, taken along the line 7-7.

The present invention is directed to a potty training device 100 comprising a bendable urine-deflector 2, a plurality of attachment tabs 1, and a means for attaching the potty training device to the underside of a toilet seat. More specifically, the potty training device 100 is configured such that the plurality of attachment tabs 1 are in contact with the top of the bendable urine-deflector 2 and are positioned substantially at right angles to the bendable urine-deflector 2, thereby producing a "L-shaped" configuration (or cross section) between the attachment tabs 1 and the bendable urine-deflector 2, as shown in FIG. 2. The means for attaching the potty training device 100 to the underside of the toilet seat allows the bendable urine-deflector 2 to be positioned in a curved configuration to block the opening 52 formed between the toilet seat 50 and the toilet bowl 51, to allow a surface of the bendable urine-deflector 2 to function as a urine-deflecting surface to deflect a urine stream directed towards the opening into the toilet bowl 51, as shown in FIG. 7.

In its curved configuration, the urine deflecting surface of the bendable urine-deflector 2 faces to the rear of the toilet seat. The flexibility of the potty training device 100 allows for manual manipulation into various curvatures, so as to accommodate the shape of many different toilet seats.

Figure 3:
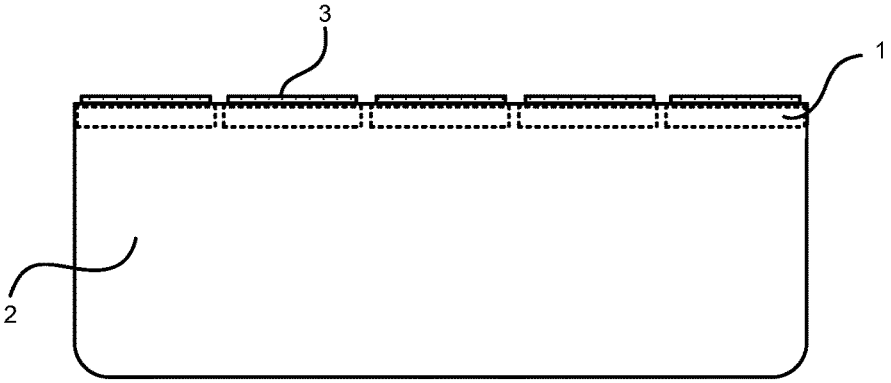
FIG. 3 is a front view of the potty training device of the present invention shown in FIG. 1.

The urine-deflector 2 preferably has a rectangular configuration, as shown in FIG. 3. The height of the urine-deflector 2 is defined as the length from the top edge to the bottom edge of the urine-deflector 2. The width of the urine-deflector 2 is defined as the length between its left edge and right edge. The width of the urine-deflector 2 is greater than its height.

The width of the urine-deflector 2 is selected to provide sufficient coverage for the variation in the lateral direction of a child's urine stream. While not intending to be limited to any particular width for the urine-deflector 2, preferred widths are from 6-9 inches. The height of urine-deflector 2 is selected to allow the urine-deflector 2 to completely block the opening formed between the underside of the toilet seat 50 and the top of the toilet bowl 51. While not intending to be limited to any particular height for urine-deflector 2, preferred heights range from 1-3 inches. In a particular embodiment of the invention, the urine-deflector 2 has a rectangular dimension of 6 inches by 3 inches or 6 inches by 1.5 inches.

Additionally, the dimensions of the urine-deflector 2 are sufficient to avoid contact with the toilet bowl 51 when the toilet seat 50 is lifted to, or lowered from, a vertical position. Further, the potty training device 100 once attached, is not visible to the observer unless the toilet seat 50 is raised, is in an upright vertical position or is viewed from a position to the rear of the attachment point when the toilet seat 50 is down.

The present invention is also directed to a potty training device 100 comprising a bendable urine-deflector 2, a plurality of attachment tabs 1, and an adhesive material 3 applied to each attachment tab 1, wherein the adhesive material 3 attaches the potty training device 100 to the underside of a toilet seat 50.

Figure 1:
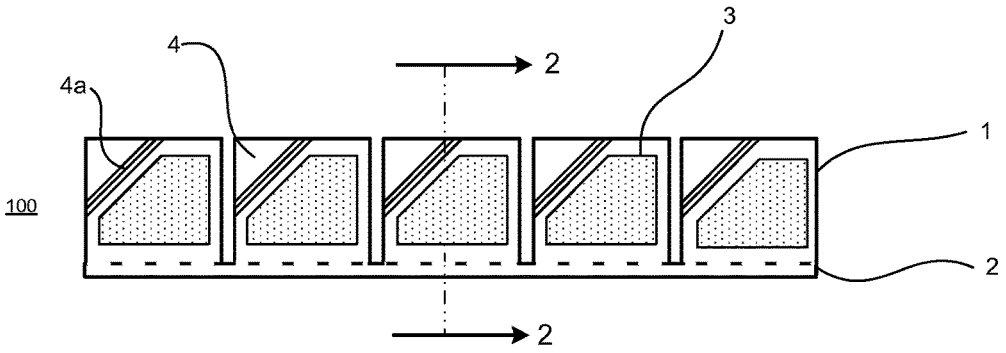
FIG. 1 is a top view of the potty training device of the present invention.

As depicted in FIG. 1, the potty training device 100 comprises a plurality of attachment tabs 1, wherein each attachment tab 1 is in contact with the urine-deflector 2, positioned substantially at right angles relative to the urine-deflector 2, as shown in FIG. 2. The potty training device 100 of the present invention may comprise any number of attachment tabs 1. Depending on the size of the width of the urine-deflector 2, from 4-10 attachment tabs 1 are preferred. An odd number of attachment tabs 1 is particularly preferred, because the center attachment tab provides a visual reference point for centering the potty training device 100 at the attachment point on the underside of the toilet seat 50. Thus, in a particular embodiment of the invention, 5, 7 or 9 attachment tabs 1 are preferred. All attachment tabs 1 preferably have the same dimensions and are evenly distributed across the width of the urine-deflector 2.

In order to attach the potty training device 100 to the underside of the toilet seat, an adhesive material 3 is applied on each attachment tab 1. The adhesive material 3 can be applied by any suitable means, for example, by layering, coating or printing, and the adhesive is, preferably, applied as a solid layer, although it is also possible to apply the adhesive in a pattern of discrete islands of adhesive, for example, in the form of dots or squares or other shapes, as is well known in the adhesive arts.

Figure 4:
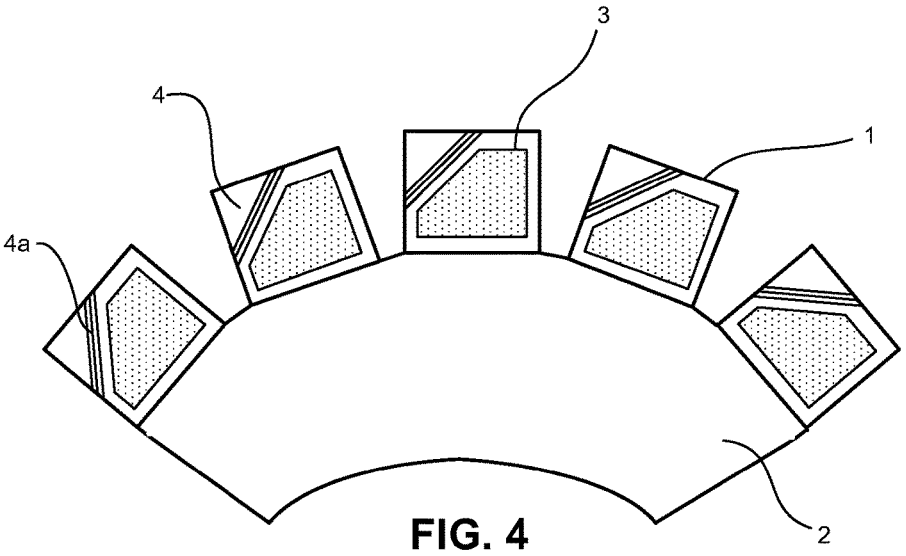
FIG. 4 is a top view of the potty training device of the present invention in a curved configuration, showing separation of the top corners of adjacent attachment tabs.
Figure 5:
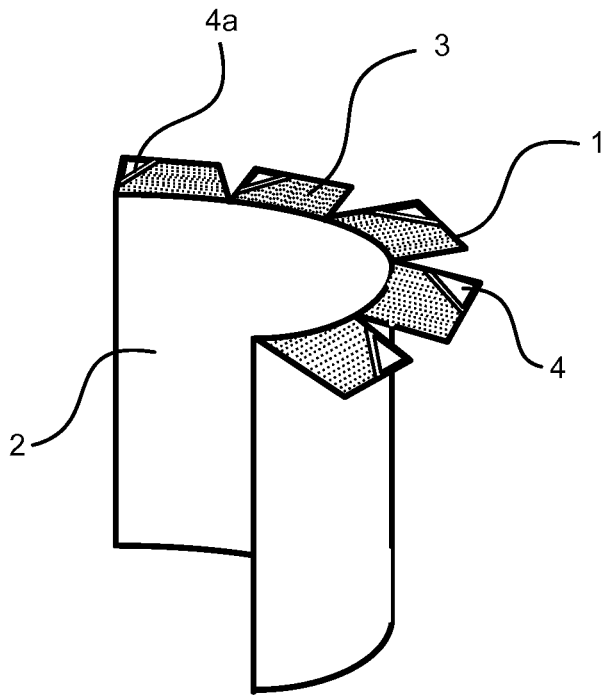
FIG. 5 is a plan view of the potty training device depicted in FIG. 4.
Figure 6:
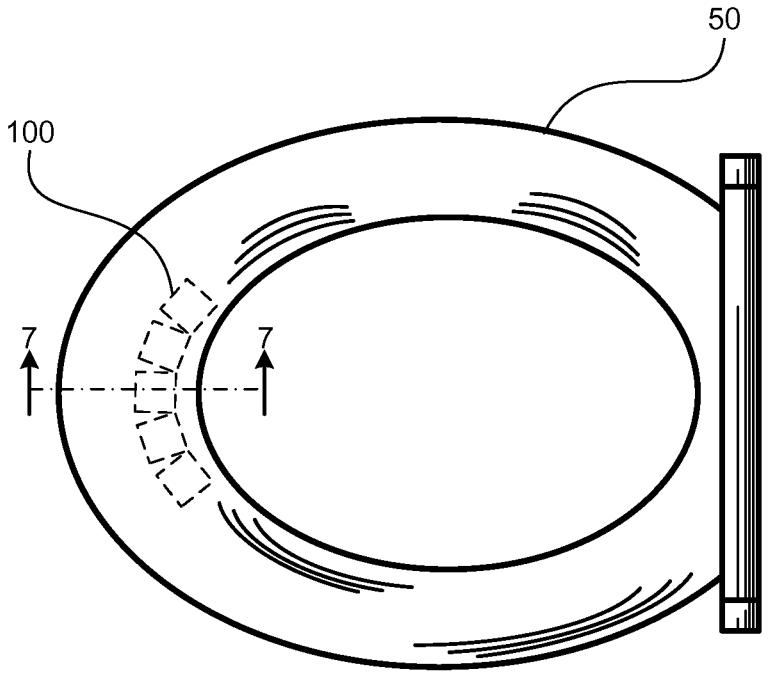
FIG. 6 is top view of the potty training device depicted in FIG. 5, attached to the underside of a toilet seat.

The potty training device 100 is applied to the underside of the toilet seat by manipulating the device into a curved configuration as shown in FIG. 4. More specifically, the curved configuration is achieved by bending the left and right edges of the bendable urine-deflector 2 inward, such that the plurality of attachment tabs 1 separate. In this curved configuration, the adhesive material 3 on the plurality of attachment tabs 1 is pressed against the underside of the toilet seat 50, such that the curvature of the bendable urine-deflector 2 matches the curvature of the toilet seat 50.

While any means for attaching the potty training device 100 to the underside of a toilet seat 50 can be used, an adhesive material 3 is preferred. The adhesive material 3 is a preferably pressure-sensitive adhesive strip (such as, for example, "double sided tape") or resin that is applied to each attachment tab 1, and once applied to the underside of the toilet seat 50, is preferably strong enough to hold the potty training device 100 in place until physically removed by the consumer and not damage the finish of the toilet seat 50 during removal.

The adhesive material 3 is preferably water-resistant and non-porous. The adhesive material 3 is also preferably applied to the plurality of attachment tabs in a thin layer coating or as a thin sheet, where an adhesive strip is used. While not compromising the ability of the adhesive material 3 to hold the potty training device 100 in place, the application of the adhesive material 3 to the plurality of attachment tabs 1 should be as thin as possible, so as to not create large gaps between the potty training device 100 and the underside of the toilet seat 50. Such large gaps could allow urine to accumulate therein and contribute to excessive odor development. While it is understood that regardless of how thin the adhesive material 3 applied to the plurality of attachment tabs 1 is, small gaps may likely exist, and urine may find its way into such gaps by capillary action. The benefit of having small gaps, however, is that use of a cleaning solvent such as alcohol, will also enter the small gaps by capillary action and thereby reduce or eliminate odor development. Therefore, any gaps that are formed by the presence of the adhesive material 3 on the plurality of attachment tabs 1 should be as small as possible to aid in the ability to clean the potty training device 100.

In order to assist with removal of potty training device 100 from the toilet seat, in another embodiment of the invention, each individual attachment tab 1 may comprise a release tab 4, as shown in FIGS. 1, 2, 4 and 5. The release tabs 4 allow the consumer to pull the potty training device away from the toilet seat, without touching the urine-deflector 2. The release tabs 4 comprise a section of the attachment tabs 1, which does not contain any adhesive material 3, thereby allowing the consumer to, for example, grasp a non-adhesive containing section of the attachment tab 1 between their thumb and index finger, and pull the attachment tab 1 away from the toilet seat. By way of example, as shown in the drawings, the release tabs 4 are engaged by bending or folding down a small section of the attachment tab 1 along a bending or folding seam 4*a*.

While the release tabs 4 shown in the drawings represent one possible configuration for this element of the invention, other configurations for this element of the invention are also possible. Suitable configurations for the release tabs 4 are those that will allow the consumer to easily grasp a portion of the attachment tab 1 with their thumb and index finger and pull successive attachment tabs 1 away from the toilet seat 50 thereby removing the potty training device 100. Regardless of the configuration of this embodiment, the adhesive material 3 is not applied to the release tab 4. Once removed from the toilet seat, the potty training device 100 may be discarded in the trash.

In another embodiment of the present invention, the potty training device 100 is made from a flexible, water-resistant and preferably non-porous material. Any material having these characteristics is suitable for the invention. In a particular embodiment of the invention, the potty training device 100 is made from a rubber or plastic resin material, wherein a plastic resin material is particularly preferred. While any plastic resin material having the above characteristics can be used, plastic resin materials may be selected from, but not limited to: polyethylene, polypropylene, polystyrene, polyvinylchloride (PVC) and polytetrafluoroethylene (PTFE).

Other types of plastic resin materials that are suitable for making the potty training device 100 of the present invention include thermoplastic elastomer (TPE) materials. TPE materials are particularly preferred as they are well suited for use in injection molding processes, produce products that are flexible, strong and tear resistant, have a rubbery feel and texture, and are soft to the touch. Examples of TPE material suitable for making the potty training device of the present invention include, but are not limited to: ONFLEX, DYNAFLEX, KRATON, ARNTITEL, ENGAGE, HYTREL, DRYFLEX and MEDIPRENE. DYNAFLEX is a preferred TPE material for making the potty training device 100 of the present invention.

To further assist in maintaining the sanitary condition of the potty training device 100 of the present invention, may also be treated with any compound that inhibits the formation of odor, bacteria, mold or other urine associated growth. The potty training device 100 may also be a medical grade type material, such as a medical grade plastic for example, that is also resistant to the formation of odor, bacteria, mold or other urine associated growth, provided that the selected material has the desired flexibility characteristics previously described.

The invention has been described in terms of illustrative embodiments. It will be understood by those of ordinary skill in the art that various modifications and changes may be made to these embodiments without departing from the spirit or scope of the invention. It is intended that the invention not be limited in any manner by the embodiments shown and described herein.

What is claimed is:

1. A potty training device comprising:

a bendable urine-deflector;

a plurality of attachment tabs, wherein said plurality of attachment tabs are in contact with the top of said bendable urine-deflector and are permanently positioned substantially at right angles to the bendable urine-deflector; and a means for attaching said potty training device to the underside of a toilet seat;

wherein the device lacks a folding seam between said bendable urine-deflector and said plurality of attachment tabs;

wherein said bendable urine-deflector can be positioned in a curved configuration and attached in said curved configuration via said means for attaching to the underside of said toilet seat to block an opening formed between the toilet seat and a toilet bowl to which said toilet seat is attached, and a surface of said bendable urine-deflector serves as a urine-deflecting surface to deflect a urine stream directed towards said opening into the toilet bowl.

2. The potty training device according to claim 1, wherein said bendable urine-deflector has a flat configuration when not attached to the underside of the toilet seat.

3. The potty training device according to claim 2, wherein said means for attaching said potty training device to the underside of a toilet seat comprises an adhesive material applied to a plurality of attachment tabs.

4. The potty training device according to claim 3, wherein each attachment tab within said plurality of attachment tabs further comprises a release tab.

5. The potty training device according to claim 4, wherein said potty training device is made from a plastic resin material.

6. The potty training device according to claim 5, wherein said plastic resin material is selected from: polyethylene, polypropylene, polystyrene, polyvinylchloride, polytetrafluoroethylene, or a thermoplastic elastomer.

7. The potty training device according to claim 6, wherein said plastic resin material is a thermoplastic elastomer.

8. The potty training device according to claim 3, wherein said adhesive material is a pressure-sensitive adhesive resin or pressure-sensitive double-sided tape.

9. The potty training device according to claim 8, wherein said adhesive material is water-resistant.

10. A method of potty training comprising:

providing a potty training device according to claim 3;

attaching the device to the underside of a toilet seat with the aid of said adhesive material in a position to block an opening formed between the toilet seat and a toilet bowl to which said toilet seat is attached so that the urine-deflecting surface deflects a urine stream directed towards said opening into the toilet bowl.

11. A method of preventing urine from passing through an opening formed between the toilet seat and a toilet bowl to which said toilet seat is attached, said method comprising:

providing a potty training device according to claim 3;

attaching the device to the underside of said toilet seat with the aid of said adhesive material in a position to block said opening formed between the toilet seat and the toilet bowl so that the urine-deflecting surface deflects a urine stream directed towards said opening into the toilet bowl.

12. The potty training device according to claim 1, wherein said plurality of attachment tabs are positioned at right angles to the bendable urine-deflector.

13. The potty training device according to claim 1, wherein said bendable urine-deflector is made of a material that resists tearing or breaking (A) during positioning in said curved configuration and attaching in said curved configuration via said means for attaching to the underside of said toilet set and (B) during removal from said toilet seat after attaching via said means for attaching to the underside of said toilet seat.

14. A method of potty training comprising:

providing a potty training device according to claim 1;

attaching the device to the underside of a toilet seat with the aid of said means in a position to block an opening formed between the toilet seat and a toilet bowl to which said toilet seat is attached so that the urine-deflecting surface deflects a urine stream directed towards said opening into the toilet bowl.

15. The potty training method according to claim 14, wherein said attaching of said device to the underside of a toilet seat comprises:

bending the left and right edges of said bendable urine-deflector inward such that said plurality of attachment tabs separate and the curvature of the bendable urine-deflector comes to match the curvature of said toilet seat; and pressing said adhesive material on said attachment tabs now separated against the underside of a toilet seat to fix the curvature of the bendable urine-deflector as matching the curvature of the said toilet seat.

16. A method of preventing urine from passing through an opening formed between the toilet seat and a toilet bowl to which said toilet seat is attached, said method comprising:

providing a potty training device according to claim 1;

attaching the device to the underside of said toilet seat with the aid of said means in a position to block said opening formed between the toilet seat and the toilet bowl so that the urine-deflecting surface deflects a urine stream directed towards said opening into the toilet bowl.

* * * * *